US006364131B1

(12) United States Patent
Moylan

(10) Patent No.: US 6,364,131 B1
(45) Date of Patent: Apr. 2, 2002

(54) DISHWASHER CLIP

(76) Inventor: William A. Moylan, 13827 Fairway Island Dr. #1235, Orlando, FL (US) 32837

( * ) Notice: Subject to any disclaimer, the term of this patent is extended or adjusted under 35 U.S.C. 154(b) by 0 days.

(21) Appl. No.: 09/664,782

(22) Filed: Sep. 19, 2000

Related U.S. Application Data

(60) Provisional application No. 60/182,791, filed on Feb. 16, 2000.

(51) Int. Cl.[7] ..... A47G 19/08

(52) U.S. Cl. ..... 211/41.9; 248/316.7; 211/41.8

(58) Field of Search ..... 211/41.9, 41.8, 211/70.7; 248/316.7, 230.1, 230.7, 231.81, 508, 509, 154; D32/3

(56) References Cited

U.S. PATENT DOCUMENTS

| | | | | | |
|---|---|---|---|---|---|
| 3,289,854 | A | | 12/1966 | Kauffman | |
| 3,312,434 | A | * | 4/1967 | Simon | 248/62 |
| 3,689,687 | A | * | 9/1972 | Bosch | 174/161 R |
| 4,953,715 | A | * | 9/1990 | Celli | 211/37 |
| D311,600 | S | * | 10/1990 | Peracca | D27/183 |
| 4,974,806 | A | | 12/1990 | Matern | 248/499 |
| D314,256 | S | | 1/1991 | Patera et al. | D32/3 |
| 5,405,018 | A | | 4/1995 | Anthrop, Jr. | 211/13 |
| 5,580,025 | A | | 12/1996 | Cross | 248/507 |
| 5,918,749 | A | | 7/1999 | Pille et al. | 211/41.9 |

* cited by examiner

*Primary Examiner*—Leslie A. Braun
*Assistant Examiner*—Gwendolyn Baxter
(74) *Attorney, Agent, or Firm*—Patent & Trademark Services; Thomas Zack; Joseph H. McGlynn

(57) ABSTRACT

A dish ware holding or anchoring device that interconnects the existing support structure for dish ware in a dishwasher to individual dish ware pieces to prevent their movement. The holding device has an alligator style anchor clip at one end connected by a-flexible connector to a prong receiving opposite anchor end. Typically, the existing dish ware support structure used in a dishwasher has an opened end prong over which a hole in the prong receiving anchor end may snugly sidle and fit over. The opposite end alligator style anchor clip end is attached to the to be retained piece of dish ware, like a cup bowl, measuring cup, etc. which piece has been inverted when placed on the support structure to prevent the accumulation of liquids. By so anchoring the dish ware to be cleaned with the existing structure of the dish ware support, the individual pieces are retained in position and no liquids are retained by them. The alligator anchor style clip end consists of two sections with free ends normally biased to a closed position by an internal spring that encircles a pin between the sections. The hole in the prong receiving anchor is just slightly greater in diameter than the prong's free end to provide for a snug fit over the prong.

1 Claim, 1 Drawing Sheet

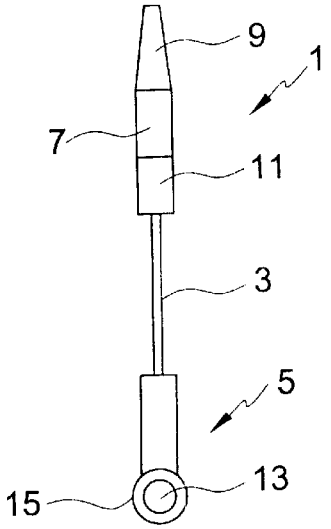
FIG.1
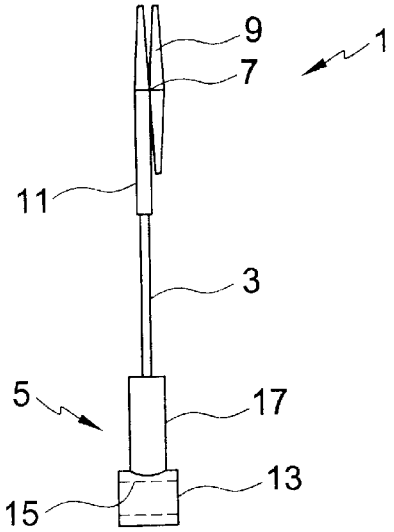
FIG.2
FIG.3
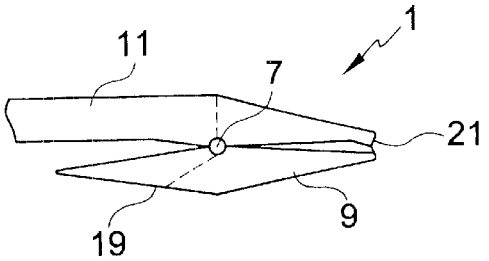
FIG.4
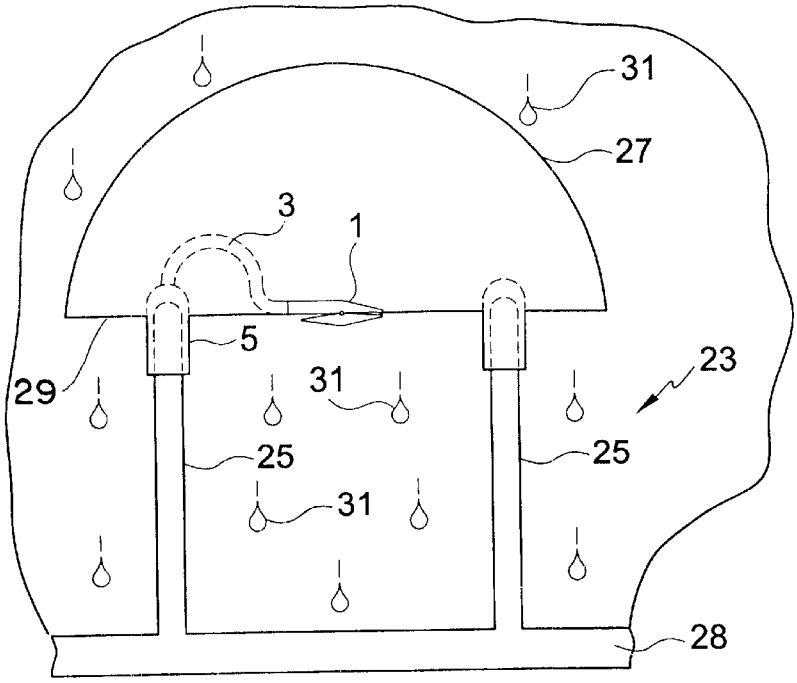

DISHWASHER CLIP

This application claims the benefit of the U.S. Provisional application No. 60/182,791 filed Feb. 16, 2000.

BACKGROUND OF THE INVENTION

The invention relates to a holding device used in a dishwasher to hold small objects to the existing internal tray structure.

Dishwashers save users considerable time and effort over hand washing of dishes. For small objects, like plastic cups or bowls, measuring spoons, and the like, placing them in a dishwasher in many cases results in them turning over and being filling with impacting liquids during the washing cycle. When such objects are emptied from the dishwasher the contained liquids may spill on the floor resulting in a messy procedure and may leave stains on the same resulting in them having to be rinsed out or rewashed. In order to insure the objects to be cleaned will not be placed in position in the dishwasher to retain liquids an anchoring system is proposed by the present invention which anchors the objects to the existing conventional tray structure of the dishwasher.

Many types of object holders are known in the prior art. For example, one U.S. design patent shows a removable article holder for a dishwasher.

In another earlier invention, an article retaining device having a base to receive an upwardly projecting element with a retainer means extending from the base that bears against the projecting element to retain an article there between is disclosed.

Another prior art holding device discloses a flexible dishwashing accessory having elongated flexible cords that put pressure on utensils to be retained.

Still another holding device discloses a dishwasher rack attachment that is used with dishwasher plastic bags.

Other additional holding device inventions disclosed have base members that engages a dishwasher rack prong and a retaining device extending from the base.

DESCRIPTION OF THE PRIOR ART

Devices used to hold objects, such as in dishwashers, are disclosed in the known prior art. For example, U.S. design Patent Des. 314, 256 to Patera et al. shows a removable article holder for a dishwasher.

U.S. Pat. No. 3,289,854 to Kauffman discloses an article retaining device having a base to receive an upwardly projecting element with a retainer means extending from the base that bears against the projecting element to retain an article there between.

U.S. Pat. No. 4,974,806 to Matern discloses a flexible dishwashing accessory having elongated flexible cords that put pressure on utensils to be retained.

U.S. Pat. No. 5,405,018 to Anthrop, Jr. discloses a dishwasher rack attachment used with dishwasher plastic bags.

U.S. Pat. Nos. 5,580,025 to Cross and 5,918,749 to Pille et al. disclose devices with a base member that,engages a dishwasher rack prong and has a retaining device extending from the base.

In the present invention a holding device for an object to be placed within a dishwasher has an anchor clip on one end joined by a flexible connection to distal anchor used to hold the device to the existing structure of a dishwasher all as will be detailed in the specification that follows hereafter.

SUMMARY OF THE INVENTION

This invention relates to a holding device used to hold small objects, like cups, bowls, measuring spoons, and the like, to the internal existing structure of a dishwasher to anchor the object and prevent it from moving during the washing cycle.

It is the primary object of the present invention to provide for an improved holding device for objects placed within the dishwasher to prevent them from moving excessively and filling with liquids during the dishwasher's washing cycle.

Another object is to provide for such a device wherein an anchor is joined to the object to be held at one end with a flexible or sturdy connection having another anchor to hold the device to the existing structure used to supporting dish ware placed in the dishwasher.

These and other objects and advantages of the present invention will become apparent to readers from a consideration of the ensuing description and the accompanying drawings.

BRIEF DESCRIPTION OF THE DRAWINGS

FIG. 1 is a top view of the present invention.

FIG. 2 is view of the invention shown in FIG. 1.

FIG. 3 is an enlarged side view of the alligator clip used in the invention shown in FIG. 1.

FIG. 4 is a schematic view of the invention shown in FIG. 1 anchored to existing tray structure of a dish ware at one end and to dish ware at the other end.

DESCRIPTION OF THE PREFERRED EMBODIMENT

FIG. 1 is a top view of the present invention. There are three basic interconnected components of the invention namely, the alligator anchor clip 1 mounted on a flexible and solid plastic elastic connector 3 with the prong anchor 5 on the end opposite the clip 1. The anchor clip 1 is an alligator style clip that has an internal pivot pin 7, shown in dotted line format in this view, with a tension spring that normally biases one section 9 of the clip 1 into a closed contacting position with respect to the larger underlying other base clip section 11, as best shown in FIG. 3. Both opposite end anchors 1 and 5 are interconnected by the flexible and elastic short length connector 3. By using such a connector a user is able to have a degree of bending flexibility between the prong anchor when this anchor 5 is connected to the existing structure of the dishwasher that conventionally supports dish ware and the anchor clip 1 attached to the dish ware to be held in place.

The prong anchor 5 is configured with an end center hole 13 in lower base head member 11 . Hole 13 slides over and down on an upstanding vertical prong in the conventional dish ware supporting structure in the dishwasher, as best show in FIG. 4. A snug fit between the dishwasher support prong and the hole 13 is desired to prevent the dislodgement of the anchor prong 5 from its support. This is accomplished by preselecting the diameter of hole 13 is be just slightly larger than the cross section diameter of the engaged prong. Using a dishwasher safe materials for the individual components, like soft plastic materials, insures long life and no marring of the. dishes and other dish ware being washed by the holder.

FIG. 2 is a side view of the invention shown in FIG. 1. The lower base head 15 has a hole 13 that extends the total length of the head. The dotted lines represent this through hole 13. Above the head 15 and rigidly attached to it is the extension member 17. This attachment may be by a nipple apparatus or another flexible element. Upstanding member 17 is used to firmly mount one end of connector 3 to the lower prong anchor 5. The other end of connector 3 is firmly connected to the end of base clip section 11. Joined to clip section 11 is the upper smaller clip section 9. The pivot pin 7 is located between the two clip sections 9 and 11 and extends through a hole in a coil type spring with two free ends. (see FIG. 3).

FIG. 3 is an enlarged side view of the alligator anchor clip 1 used in the invention shown in FIG. 1. The sections 9 and 11 each have a free end that is normally biased to a closed position with respect to the other section. The larger base clip section 11 is partially shown on the top with the smaller anchor clip section 9 connected by the coil spring 1 9, shown in dotted line format, and the pin 7. The two free ends of the spring are fixedly mounted into the two sections 9 and 11 with a circular spring hole between them used to mount the pin 7. This conventional configuration for an alligator clip insures the movable section 9 will be biased into engagement with the section 11 at the engaged front free section ends. Two protruding facing lugs 21, one on each of the free end sections of 9 and 11, touch each other when the clip is in a closed position to insure any retained surface between the free end sections and lugs will not slip away from the anchor clip 1. For example, if the side surface or handle of a cup were between the lugs 21 with the prong anchor 5 attached to an existing dish ware support structure, then movement of the cup would be restricted to prevent it from turning over and holding any liquids dispensed during the washing cycle. The term washing cycle of the dishwasher includes all of the phases an automatic dishwasher normally operates through including, but not limited to, washing, rinsing and drying.

FIG. 4 is a schematic view of the invention shown in FIG. 1 anchored to the existing tray structure 23 of a dish ware at one end 5 and to the dish ware at the other end 1. Many existing supporting structures used to hold dish ware in dishwashers and have vertically spaced prongs 25 with free upper ends. The lower ends of these supporting structures are joined to lower horizontally connected frame members 28. Normally, the upper ends of the prongs 25 and the supporting structure for the dish ware has a plastic protective covering to insure no marring or scratching of the supported dish ware during the washing cycle. In FIG. 4, an inverted dome shaped bowl 27 has been placed upside down with its encircling lower lip 29 shown engaged by the alligator anchor clip end 1. Droplets of liquid 31 are shown impinging the upon exposed surface of the bowl and dropping downwardly therefrom. During the somewhat violent action of the dishwasher washing cycle, it would normally be possible for the seated, bowl to become dislodged from the supporting prongs 25 and inverted to be filled with a liquid, like water or a combination of water and detergent. By anchoring the bowl to the existing support structure 23 conventionally used to hold dish ware during the washing cycle, this liquid filling condition is eliminated or at least greatly reduced. More than one such holding clip may be used on large pieces of dish ware and it is contemplated that at least one holding clip should be used with each dish ware piece capable of being up righted to hold liquids.

The dishwasher clip of the present invention is a small, lightweight holding device made of a dishwasher safe material. Its greatest use would be with lightweight dish ware like plastic bowls, cups or other lightweight house ware items normally placed in dishwashers. The anchors connector 3 is a short elastic band made from rubber, plastic or a synthetic fiber that is both anti corrosive and water resistant. The total length of the prong anchor 5 would typically be about ½ inch long with a a diameter slightly over ⅛ of an inch. Different sizes for the present invention are envisioned to accommodate different sized dish ware to be held. A set of holding clips would be used for the different sized items to be cleaned. Using known injection molding methods the invention may be mold as a single unit. The term dish ware as used herein includes, but is not limited to, cups, bowls, measuring spoons, and any lightweight plastic items normally washed in a dishwasher.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A combined holding device and dish ware support comprising:

a dish ware support having a prong with a free end, a holding device having a first anchor end, said first anchor end having a clip biased to a closed clip position, said closed clip being adapted to hold dish ware, said holding device having a second anchor end, a flexible connector attached between the first anchor end and the second anchor end, said clip of the first anchor end being pivotally mounted to the flexible connector to move pivotally with respect to the flexible connector, and said second anchor end having with a hole that is received over the free end of the dish ware support prong.

* * * * *